US008286704B2

(12) United States Patent
Chan et al.

(10) Patent No.: US 8,286,704 B2
(45) Date of Patent: Oct. 16, 2012

(54) COILED TUBING CONVEYED COMBINED INFLOW AND OUTFLOW CONTROL DEVICES

(75) Inventors: Keng Seng Chan, Kuala Lumpur (MY); Kim Fah Goh, Melaka (MY); Bipin Jain, Pin (IN)

(73) Assignee: Schlumberger Technology Corporation, Sugar Land, TX (US)

( * ) Notice: Subject to any disclaimer, the term of this patent is extended or adjusted under 35 U.S.C. 154(b) by 284 days.

(21) Appl. No.: 12/606,303

(22) Filed: Oct. 27, 2009

(65) Prior Publication Data

US 2010/0108313 A1 May 6, 2010

Related U.S. Application Data

(60) Provisional application No. 61/109,675, filed on Oct. 30, 2008.

(51) Int. Cl.
*E21B 43/00* (2006.01)

(52) U.S. Cl. ..... 166/263; 166/312; 166/227

(58) Field of Classification Search ..... 166/305.1, 166/263, 312, 369, 227, 381, 50
See application file for complete search history.

(56) References Cited

U.S. PATENT DOCUMENTS

| | | | | |
|---|---|---|---|---|
| 4,860,831 | A * | 8/1989 | Caillier | 166/384 |
| 5,141,054 | A * | 8/1992 | Alameddine et al. | 166/252.1 |
| 6,192,983 | B1 * | 2/2001 | Neuroth et al. | 166/250.15 |
| 6,454,014 | B2 | 9/2002 | Coats | |
| 7,419,002 | B2 * | 9/2008 | Dybevik et al. | 166/205 |
| 2003/0121663 | A1 * | 7/2003 | Weng et al. | 166/308 |
| 2006/0237191 | A1 * | 10/2006 | Yeo et al. | 166/265 |
| 2008/0041594 | A1 | 2/2008 | Boles | |
| 2008/0149351 | A1 | 6/2008 | Marya | |
| 2008/0169099 | A1 | 7/2008 | Pensgaard | |

FOREIGN PATENT DOCUMENTS

| | | |
|---|---|---|
| WO | 2007092082 | 8/2007 |
| WO | 2007092083 | 8/2007 |
| WO | 2007126496 | 11/2007 |

* cited by examiner

*Primary Examiner* — Giovanna Wright
*Assistant Examiner* — Richard Alker
(74) *Attorney, Agent, or Firm* — David G. Matthews; Rodney Warfford; Robb D. Edmonds

(57) ABSTRACT

Methods and systems of hydrocarbon production where wellbore stimulation and production is achieved in a single wellbore run-in, and inflow control devices are installed in an existing wellbore completion. A coiled tubing string is conveyed into a substantially horizontal portion of a wellbore, where the coiled tubing string has a production tubular configured to execute both stimulation and recovery operations. The production tubular can include an inflow control device to be installed in an existing wellbore.

20 Claims, 3 Drawing Sheets

COILED TUBING CONVEYED COMBINED INFLOW AND OUTFLOW CONTROL DEVICES

CROSS-REFERENCE TO RELATED APPLICATIONS

This application claims priority to U.S. Provisional Patent Application having Ser. No. 61/109,675, filed on Oct. 30, 2008, which is incorporated by reference herein in its entirety.

BACKGROUND

In recent years, the development and deployment of inflow control devices (hereinafter ("ICD") has yielded great results and significantly improved the horizontal well production and reserve recovery of existing hydrocarbon wells. For example, in a well producing from a number of separate hydrocarbon-bearing zones, one hydrocarbon-bearing zone may have a higher pressure than another hydrocarbon-bearing zone. Without proper management, the higher pressure hydrocarbon-bearing zone may produce into the lower pressure hydrocarbon-bearing zone rather than to the surface.

In horizontal wells lacking proper management, hydrocarbon-bearing zones near the "heel" of the well (closest to the vertical or near vertical part of the well) may begin to produce unwanted water or gas (referred to as water or gas coning) before those zones near the "toe" of the well (farthest away from the vertical or near vertical departure point) begin producing unwanted water or gas. Production of unwanted water or gas in any one of these hydrocarbon-bearing zones requires special interventions to stop its production. The implementation of ICD technology serves to regulate, or normalize, the overall draw-down pressure along the length of the horizontal wellbore, thereby reducing the inflow profile impairment between the heel and toe of the well.

The installation of ICDs along the length of a horizontal wellbore is typically permanent and is generally part of the initial wellbore completion in a newly drilled well. Technology today, however, provides no way to put an ICD in an existing well completion. Instead, a complete change in the wellbore completion (i.e., re-completion) may have to occur for the installation of an ICD—an undertaking that can prove to be very costly and time-consuming. Furthermore, re-completion operations, including ICD installation in an existing wellbore, would typically follow wellbore stimulation operations, such as fracing. As is well-known, fracing operations generally requires a separate run into the wellbore, thus also demanding a substantial amount of cost and time. Accordingly, the high cost of replacing an existing completion with a new completion integrated with ICD technology may severely prohibit ICD use in, e.g., existing horizontal wells.

There is a need, therefore, for a cost-efficient method of implementing ICD technology with wellbore stimulation operations for both new and existing wellbores, thereby obtaining a high-productivity ICD completion.

SUMMARY

Methods and systems of hydrocarbon production are provided. In one or more embodiments, a method can include conveying a coiled tubing string from the surface into a wellbore. The wellbore may be newly created or existing, but having a substantially horizontal portion disposed in a hydrocarbon-bearing formation. The method further includes disposing a production tubular of the coiled tubing string in the substantially horizontal portion, wherein the production tubular comprises a base pipe defining a plurality of orifices and also has axial spacer strips secured to an outer periphery of the base pipe, and a sand control screen disposed about the axial spacer strips. A fluid may then be injected into the coiled tubing string, whereby the fluid flows out the production tubular and into the hydrocarbon formation. Finally, fluids from the hydrocarbon formation can be drawn through the production tubular to the surface, wherein the coiled tubing string is run into the wellbore only a single time.

As can be appreciated, there are several advantages to this embodiment. The methods disclosed herein may be more efficient, since running tubulars into the wellbore only has to occur once for both stimulation operations (including chemical injection) and hydrocarbon recovery. This may prove to be quite valuable, especially in deep-water re-visit applications where there is a high-cost for subsea completion of deep-water production. For example, the whole operation disclosed herein can be performed with a coiled tubing unit vessel without the need of a cost-prohibitive work-over rig.

Moreover, there may be several safety advantages to the present disclosure. For example, since only a single run into the wellbore is required to accommodate both chemicals injection and subsequent production operations, less hardware and, therefore, less operational problems would be encountered. Such hardware problems that may be avoided can include tubular and mechanical leaks, tools sticking downhole, and potential operational hazards. Likewise, in deep-water re-visits, a single run into the wellbore located in more complex subsea completion locations, will likely save work-over exposure time, thereby minimizing the risk and potential safety-related issues mentioned above.

BRIEF DESCRIPTION OF THE DRAWINGS

So that the recited features can be understood in detail, a more particular description, briefly summarized above, may be had by reference to one or more embodiments, some of which are illustrated in the appended drawings. It is to be noted, however, that the appended drawings illustrate only typical embodiments and are therefore not to be considered limiting of its scope, for the invention may admit to other equally effective embodiments.

DETAILED DESCRIPTION

Embodiments of the present invention can give ICD capabilities to existing wells that did not have provisions for ICD technology when they were first completed. Advantageously, through the embodiments disclosed below, a supposed two runs into the wellbore of stimulation and subsequent production re-completion can be combined into a single run, thereby saving a significant amount of rig time and rig rental money. In addition, according to the present disclosure, this can be accomplished without requiring the removal of an existing production string of an existing well.

The embodiments disclosed herein provide several advantages, especially in deep-sea applications where well intervention and re-completion operations can be costly, and require higher-efficiency and operation safety restrictions for operation justification. Where there are existing horizontal wells in need of treatment or re-completion in order to revive their economic value, the embodiments disclosed herein can provide a safer and more efficient operation for any well intervention that is deemed unavoidable. As such, one or more embodiments can include a combined operation of controlling a coil-tubing conveyed chemicals injection with an in-situ conversion to an inflow control device. Thus, the coil tubing can be used for both stimulation outflow and production inflow processes, all in a single run-in to the wellbore. The simple tubular insertion described herein dramatically converts an existing horizontal well completion, regardless of its complexity, to a high productivity ICD completion.

Figure 1:
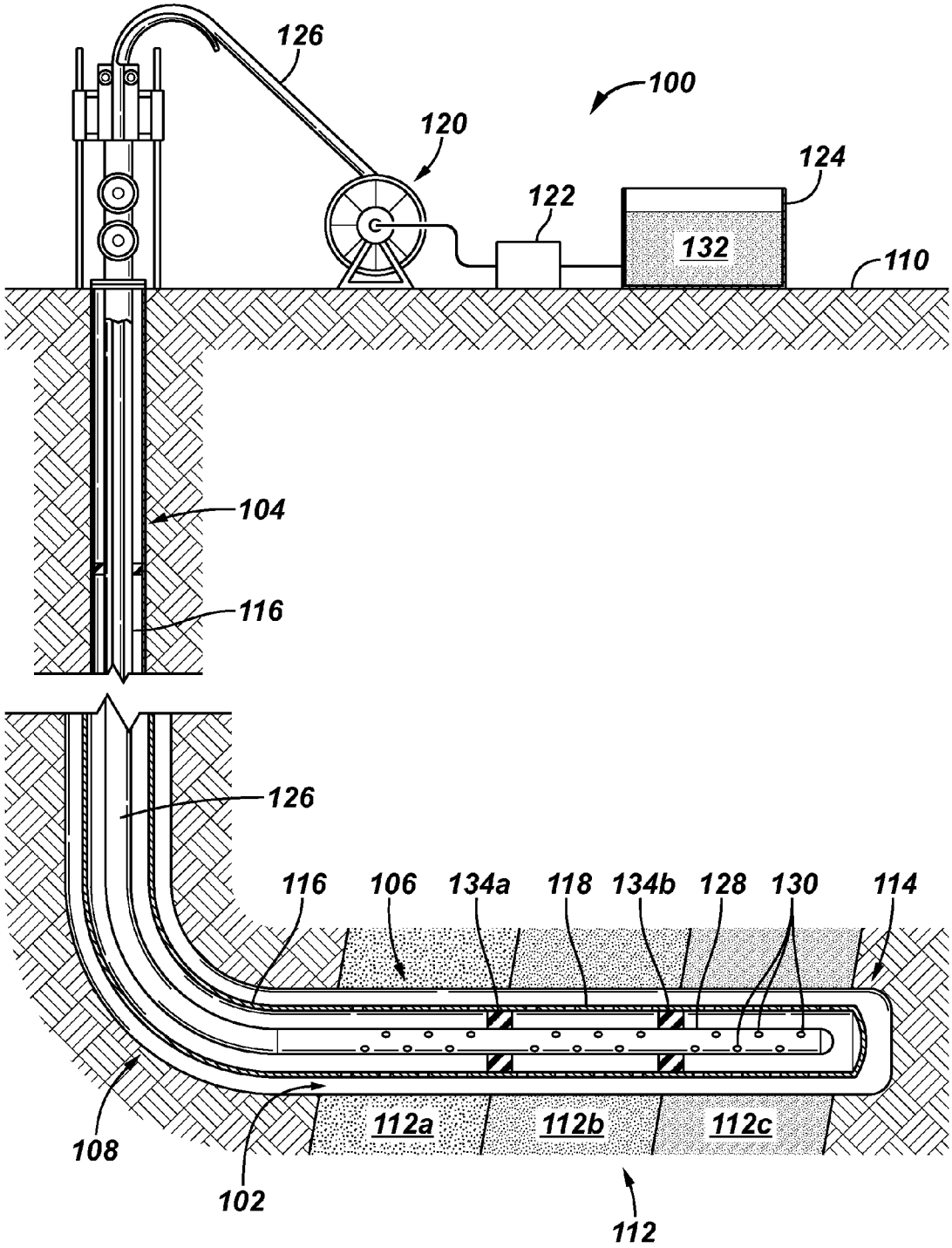
FIG. 1 depicts a schematic view of an exemplary hydrocarbon recovery system disposed within a wellbore, according to one or more embodiments described.

FIG. 1 depicts a schematic view of an exemplary embodiment of a hydrocarbon recovery system 100, according to at least one embodiment of the present disclosure. In an exemplary embodiment, the system 100 can be configured to combine wellbore stimulation operations with the implementation of at least one ICD, thereby eliminating costly and time-consuming dual run-ins into the hole. For the purposes of this disclosure, a "run-in" can include the process of running drilling pipe, coiled tubing for stimulation, production pipe, etc., into a well, and removal of the same. As will be described in more detail below, embodiments of the disclosure can combine the operation of coil-tubing conveyed outflow-control chemical injection with ICD technology, thereby providing in-situ conversion of an injection (outflow) mechanism to inflow production without requiring separate run-ins.

As illustrated in FIG. 1, a wellbore 102 can have a substantially vertical portion 104 and a substantially horizontal portion 106 joined at a "heel" 108. From the heel 108, the vertical portion 104 can extend to the surface 110, while the horizontal portion 106 can extend into a heterogeneous hydrocarbon-bearing formation 112, ultimately terminating at a "toe" 114. The formation 112 can include at least three zones 112*a*, 112*b*, 112*c*, each having varying degrees of permeability, as will be described below.

In an exemplary embodiment, the wellbore 102 can be either a newly-drilled or an existing wellbore 102, wherein a completion casing 116 extends substantially the whole length of the wellbore 102. As part of the completion casing 116, at least a portion of the horizontal portion 106 can include a completion assembly 118 configured to allow the outflow and inflow of fluids into the wellbore 102. In an exemplary embodiment, the completion assembly 118 can include any number of horizontal completions known in the art, including, but not limited to, a perforated casing, a gravel-packed screen assembly, an open hole and screen assembly, or simply an open hole. In at least one embodiment, the completion assembly 118 can include a slotted liner, or screen assembly with an inside diameter of about 5.5 inches.

At the surface 110, the system 100 can include a coiled tubing conveyor 120 communicably coupled to a pump 122 and a fluids reservoir 124 having a fluid 132 disposed therein. In an exemplary embodiment, the coiled tubing conveyor 120 can be configured to feed a coiled tubing string 126 down the wellbore 102 and substantially into the horizontal portion 106 of the completion assembly 118. Disposed at the end of the coiled tubing string 126, and inserted first into the wellbore 102, can be a production tubular 128 that defines a plurality of orifices 130. The production tubular 128 can be used to control the production of hydrocarbons from the wellbore 102 and/or the hydrocarbon-producing zone 112 to the surface 110. In addition, the production tubular 128 can be used to control the flow of one or more fluids flowing from the surface 110 to the wellbore 102 and/or hydrocarbon-producing zone 112.

In at least one embodiment, the production tubular 128 can be a single length of piping disposed substantially in the completion assembly 118, and having at least one packer 134*a,b* (two shown) engaged about the inner diameter of the completion assembly 118. In other embodiments, the production tubular 128 can be connected or secured in a series of pipes (not shown) about the completion assembly 118, and a "left" or first portion of one or more of the production tubulars 128, and a "middle" or second portion, can be connected or secured to a first packer 134*a*. Accordingly, the first packer 134*a* can support the first and second connected production tubulars 128. Moreover, a "right" or third portion of the production tubular 128, and the middle portion, can connect or secure to the second packer 134*b*.

In one or more embodiments, the packer(s) 134*a,b* can include a swell-packer with a cup-packer as a back-up isolation support at each transition between adjacent zones 112*a, b,c*. In exemplary operation, the packers 134*a,b* can provide zonal isolation between each production zone 112*a,b,c* of the hydrocarbon-bearing formation 112. For example, fluids entering the completion assembly 118 from a respective zone 112*a,b,c*, having differing permeability and/or viscosity are substantially isolated from each other until entering the production tubular 128.

Figure 2:
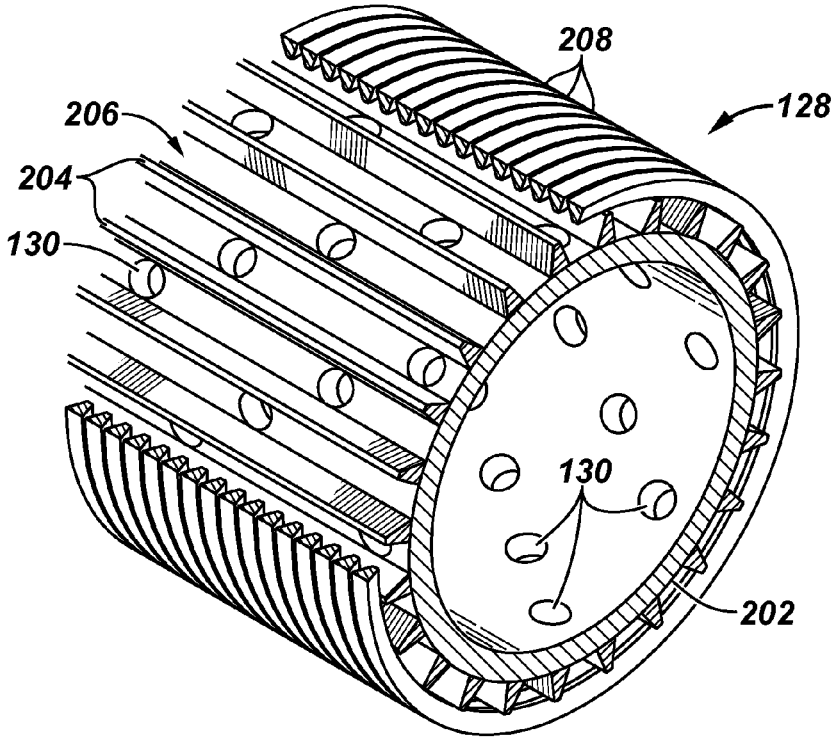
FIG. 2 depicts a partial cross-sectional view of an exemplary production tubular, according to one or more embodiments described.

Referring now to FIG. 2, illustrated is a radial, perspective view of an exemplary production tubular 128, according to at least one embodiment of the disclosure. As illustrated, the production tubular 128 can include a base pipe 202 having several axial spacer strips 204 secured to its outer periphery at mutually uniform angular distances, and running in the axial direction of the base pipe 202. Thus, several axial flow channels 206 can exist along the outside of the base pipe 202 between successive and adjacent axial spacer strips 204. The production tubular 128 can also include a sand control screen 208. In an exemplary embodiment, the sand control screen 208 can include several continuous and closely-spaced wire windings that are wound onto the outside of the axial spacer strips 204 in a manner providing a small slot opening between each wire winding. Through the slot openings in the wire windings, fluids can flow in or out of the production tubular 128, depending on the application.

As noted above, the production tubular 128 can define a plurality of orifices 130, wherein the orifices 130 are disposed about the periphery of the base pipe 202. In at least one embodiment, the orifices 130 can be configured as an integral part of an orifice-type ICD, but can equally include the integral part of a nozzle-type ICD, wherein the orifices 130 are replaced with a plurality of nozzles threaded into the base pipe 202 via corresponding threaded inserts (not illustrated). In other embodiments, the orifices 130 can be configured as part of a helical channel ICD, as are well known in the art. Indeed, the orifices 130 can include any downhole device capable of causing a pressure drop therethrough, for example, an aperture having one or more tortuous flow paths formed therethrough, a tube having a varying or reduced diameter, or an aperture having a spiral flow path formed therethrough. Each orifice 130 can be arranged and designed with a degree of pressure choking adapted to the various fluids flowing therethrough, thus obtaining equal, or nearly equal, radial inflow/outflow rate per unit length of the completion assembly 118.

Figure 3:
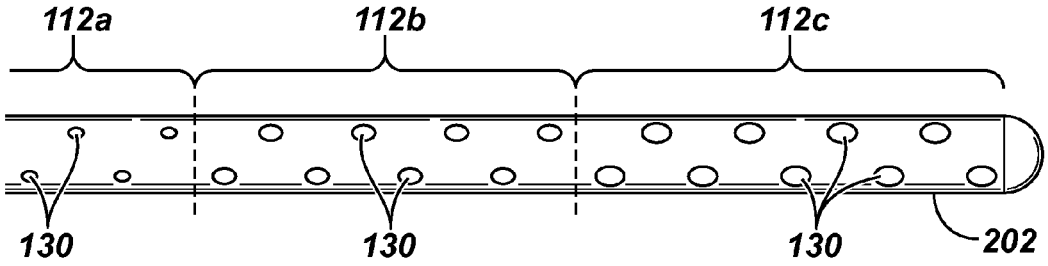
FIG. 3 depicts a cross-sectional view of an exemplary base pipe as shown in FIG. 2, according to one or more embodiments described.

Referring now to FIG. 3, with continuing reference to FIG. 2, illustrated is a partial side view of the base pipe 202 showing various sizes or densities of the orifices 130 (or nozzles). Since the production tubular 128 can be coupled to a coiled tubing string 126 (FIG. 1), the outside diameter of the base pipe 202 can be, but is not necessarily limited to, between about 1 inch to about 3 inches in diameter. As illustrated, the orifices 130 can vary in density or size depending on the location along the length of the base pipe 202 and corresponding to the adjacent production zones 112*a,b,c.* For example, the first zone 112*a* can include a medium with a permability of about 800 millidarcies ("mD"), the second zone 112*b* can include a medium with a permability of about 150 mD, and the third zone 112*c* can include a medium with a permability of about 50 mD. Based on the permeability of each zone 112*a,b,c,* the density and size of each orifice 130 may be modified. Moreover, orifice 130 sizings can be designed along a horizontal with respect to the axial direction of the base pipe 202 to achieve a more balanced outflow of a fluid/chemical injection into the heterogeneous formations while avoiding excess fluids/chemicals loading out near the heel 108 (FIG. 1) in homogeneous formations. The effect of a balanced injection design of the orifices 130 can then be reversed to achieve a balanced inflow of zonal production along the same horizontal after treatment.

As can be appreciated, the rock-fluid properties and potential flow geometry of the formation 112 are key inputs for the design of the numbers, hole sizes, and distribution density of the orifices 130. Prior to completing or re-completing a well, further information is often gathered regarding production properties and fluid compositions of the formation 112, including pressures, temperatures, etc. Usually at hand is readily-available information concerning the desired recovery rate and recovery method(s), formation 112 heterogeneity, length of the well inflow/outflow portion, estimated flow pressure losses within the coiled tubing string 126, etc. To further facilitate information gathering, a fiber optic coil (not shown) can be conveyed concomitantly with the coiled tubing string 126 for transmitting signals between downhole tools and/or the downhole environment and surface 110 equipment. Such signals can be communication signals for operating the downhole tools or measurement signals for sending real-time data to the surface 110 equipment. This data, in turn, may be used for monitoring and/or modifying the downhole operations, including deciding upon the number, relative positioning, density, and also individual design of the orifices 130.

Referring again to FIG. 1, in exemplary operation, the system 100 can be configured to perform wellbore 102 stimulation operations, including fracturing, water shut-off, or oil-seeking, and subsequently to perform an in situ conversion to an ICD hydrocarbon production operation. Once the coiled tubing string 126, including the production tubular 128, is inserted substantially down the wellbore 102 and into the horizontal portion 106, the pump 122 can convey the fluid 132 from the fluids reservoir 124 into the coiled tubing string 126. In at least one embodiment, the fluid 132 can be a fracing fluid configured to be injected into the hydrocarbon-bearing formation 112 for the purpose of wellbore 102 stimulation operations. The fracing fluid can include, but is not limited to, water, acids, gels, foams, or other wellbore 102 stimulating fluids, with or without propping agents, as known in the art.

In at least one embodiment, the orifices 130 of the production tubular 128 can include modifiable nozzles configured to control the flow rate of the injection fluid into the formation 112. By modifying the orifices 130 (or nozzles), the pressure drop across the completion assembly 118 can be fine-tuned, thereby optimizing the injection rates across the full length of the completion assembly 118, regardless of the permeability variations in the several zones 112*a,b,c,* or the presence of "thief" zones. In at least one embodiment, the injection/wellbore stimulation process can be substantially similar to the Coil-Tubing Conveyed Outflow Control Chemicals Injection (i.e., ResInject™) process developed and commercialized by Reslink, Inc.

Figure 4:
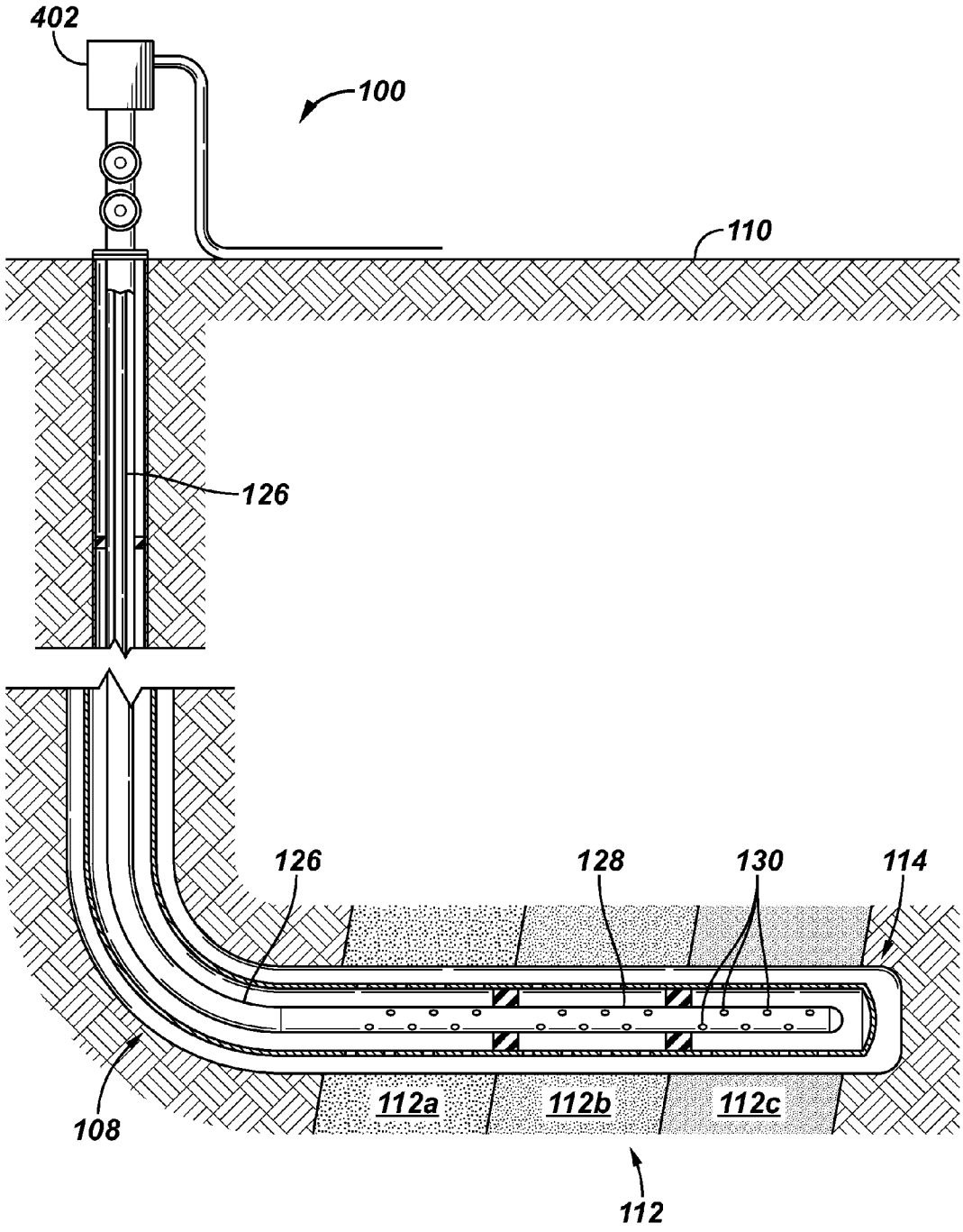
FIG. 4 depicts a schematic view of an exemplary hydrocarbon recovery system disposed within a wellbore, according to one or more embodiments described.

Referring now to FIG. 4, following the stimulation and/or treatment of the heterogeneous hydrocarbon-bearing formation 112, production completions can immediately commence without requiring a separate run-in of production piping other than the already-conveyed coiled tubing string 126. Particularly, the coiled tubing string 126 can be detached from the coiled tubing conveyor 120 (FIG. 1) at the surface 110, and in its place can be installed a pump 402, or equivalent device as is known in the art. The pump 402 can be implemented and configured to reverse the flow of fluids from the formation 112, thereby drawing fluids, including hydrocarbons, from the formation zones 112*a,b,c,* to the surface 110 for collection. Initially, the production tubular 128 can draw the residual fluids 132 (FIG. 1) left over from the stimulation/treatment process, after which hydrocarbons can be drawn from the various penetrated zones 112*a,b,c.*

In exemplary operation, the recovered hydrocarbon can be "filtered" through the sand control screen 208, as described with reference to FIG. 2. Fluids enter the screen 208, and flow to the orifices 130 (or nozzles) where a pressure drop is achieved as a result of the various sizings and densities thereof, thereby resulting in a substantially uniform hydrocarbon inflow from heel 108 to toe 114. As discussed above, orifice 130 sizing and density can be configured to substantially correspond to the permeability and/or viscosity of the adjacent zones 112*a,b,c.* In at least one embodiment, the hydrocarbon production process of drawing fluids to the surface 110 can be substantially similar to the ResFlow™ process developed and commercialized by Reslink, Inc. of Ålgård, Norway (reslink.com—a Schlumberger company—slb.com) and as disclosed in U.S. Pat. No. 7,419,002.

Because of the almost instant conversion from fluid injection stimulation operations to hydrocarbon recovery, embodiments of the present disclosure aid in immediate well/residual chemicals clean-up during production kick-off. With a shorter time-lapse between treatment and production inflow, embodiments disclosed herein reduce the unwanted invasion extent of the residual treatment chemicals, which is very common in the conventional approach.

Certain embodiments and features have been described using a set of numerical upper limits and a set of numerical lower limits. It should be appreciated that ranges from any lower limit to any upper limit are contemplated unless otherwise indicated.

As used herein, the terms "up" and "down;" "upper" and "lower;" "upwardly" and "downwardly;" "upstream" and "downstream;" and other like terms are merely used for convenience to depict spatial orientations or spatial relationships relative to one another in a vertical wellbore. However, when applied to equipment and methods for use in wellbores that are deviated or horizontal, it is understood to those of ordinary skill in the art that such terms are intended to refer to a left to right, right to left, or other spatial relationship as appropriate. The embodiments described herein are equally applicable to horizontal, deviated, vertical, cased, open, and/or other wellbore, but are described with regards to an openhole horizontal wellbore form simplicity and convenience.

Certain lower limits, upper limits and ranges appear in one or more claims below. All numerical values are "about" or "approximately" the indicated value, and take into account experimental error and variations that would be expected by a person having ordinary skill in the art.

Various terms have been defined above. To the extent a term used in a claim is not defined above, it should be given the broadest definition persons in the pertinent art have given that term as reflected in at least one printed publication or issued patent. Furthermore, all patents, test procedures, and other documents cited in this application are fully incorporated by reference to the extent such disclosure is not inconsistent with this application and for all jurisdictions in which such incorporation is permitted.

While the foregoing is directed to embodiments of the present invention, other and further embodiments of the invention may be devised without departing from the basic scope thereof, and the scope thereof is determined by the claims that follow.

The invention claimed is:

1. A method for producing fluids from an existing wellbore, comprising:

conveying a coiled tubing string from a surface into an existing completion assembly disposed in the wellbore with a coiled tubing conveyor, wherein hydrocarbons are drawn from a hydrocarbon formation through the existing completion assembly to the surface before the coiled tubing string is conveyed into the existing completion assembly, wherein the coiled tubing string comprises a production tubular including an inflow control device coupled to a first end thereof such that the production tubular is disposed within a substantially horizontal portion of the existing wellbore, and wherein the production tubular comprises:

a base pipe including a plurality of axial spacer strips coupled to an outer surface thereof;

a sand control screen including wire windings disposed about the axial spacer strips such that a plurality of small slotted openings are defined between the wire windings; and a plurality of orifices formed through the base pipe;

injecting a fracing fluid into the coiled tubing string with a first pump coupled to a second end of the coiled tubing string, whereby the fracing fluid flows out the production tubular and into the hydrocarbon formation;

decoupling the first pump from the second end of the coiled tubing string and coupling the second end of the coiled tubing string to a second pump; and drawing additional hydrocarbons from the hydrocarbon formation through the production tubular to the surface with the second pump, wherein the coiled tubing string is run into the wellbore a single time.

2. The method of claim 1, wherein the hydrocarbon formation is fraced a first time before the coiled tubing string is conveyed into the existing completion assembly, and wherein injecting the fracing fluid further comprises fracing the hydrocarbon formation a second time.

3. The method of claim 1, wherein the production tubular including the inflow control device is conveyed into the existing completion assembly without re-completing the wellbore.

4. The method of claim 1, wherein the fracing fluid comprises water, acid, gel, foam, or combinations thereof.

5. The method of claim 1, wherein the base pipe has an outer diameter between about 1 inch and about 3 inches.

6. A method for producing fluids from an existing wellbore, comprising:

conveying a coiled tubing string from a surface into an existing completion assembly disposed in the wellbore with a coiled tubing conveyor, wherein hydrocarbons are drawn from a hydrocarbon formation through the existing completion assembly to the surface before the coiled tubing string is conveyed into the existing completion assembly, wherein the coiled tubing string comprises a production tubular including an inflow control device coupled to a first end thereof such that the production tubular is disposed within a substantially horizontal portion of the existing wellbore, and wherein the production tubular comprises:

a base pipe including a plurality of axial spacer strips coupled to an outer surface thereof;

a sand control screen including wire windings disposed about the axial spacer strips such that a plurality of small slotted openings are defined between the wire windings; and a plurality of orifices formed through the base pipe;

isolating first and second production zones of the hydrocarbon formation with a packer;

injecting a fracing fluid into the coiled tubing string with a first pump coupled to a second end of the coiled tubing string, whereby the fracing fluid flows out the production tubular and into the hydrocarbon formation;

decoupling the first pump from the second end of the coiled tubing string and coupling the second end of the coiled tubing string to a second pump;

drawing additional hydrocarbons from the hydrocarbon formation through the production tubular to the surface with the second pump, wherein the coiled tubing string is run into the wellbore a single time.

7. The method of claim 6, wherein the hydrocarbon formation is fraced a first time before the coiled tubing string is conveyed into the existing completion assembly, and wherein injecting the fracing fluid further comprises fracing the hydrocarbon formation a second time.

8. The method of claim 6, wherein the production tubular including the inflow control device is conveyed into the existing completion assembly without re-completing the wellbore.

9. The method of claim 6, wherein the packer is disposed between the production tubular and the existing completion assembly.

10. The method of claim 6, wherein the first and second production zones have different permeabilities.

11. The method of claim 10, wherein the plurality of orifices are varied in density and size depending on the permeability of the first and second production zones.

12. The method of claim 6, wherein the fracing fluid comprises water, acid, gel, foam, or combinations thereof.

13. A method for producing fluids from an existing wellbore, comprising:

conveying a coiled tubing string from a surface into an existing completion assembly disposed in the wellbore with a coiled tubing conveyor, wherein hydrocarbons are drawn from a hydrocarbon formation through the existing completion assembly to the surface before the coiled tubing string is conveyed into the existing completion assembly, wherein the coiled tubing string comprises a production tubular including an inflow control device coupled to a first end thereof such that the production tubular is disposed within a substantially horizontal portion of the existing wellbore, and wherein the production tubular comprises:

a base pipe including a plurality of axial spacer strips coupled to an outer surface thereof;

a sand control screen including wire windings disposed about the axial spacer strips such that a plurality of small slotted openings are defined between the wire windings; and a plurality of orifices formed through the base pipe;

injecting a fracing fluid into the coiled tubing string with a first pump coupled to a second end of the coiled tubing string, whereby the fracing fluid flows out the production tubular and into the hydrocarbon formation;

decoupling the first pump from the second end of the coiled tubing string and coupling the second end of the coiled tubing string to a second pump;

drawing additional hydrocarbons from the hydrocarbon formation through the production tubular to the surface with the second pump, wherein the coiled tubing string is run into the wellbore a single time; and creating a pressure drop in the production tubular with the plurality of orifices to normalize recovery of the additional hydrocarbons.

14. The method of claim 13, wherein the hydrocarbon formation is fraced a first time before the coiled tubing string is conveyed into the existing completion assembly, and wherein injecting the fracing fluid further comprises fracing the hydrocarbon formation a second time.

15. The method of claim 13, wherein the production tubular including the inflow control device is conveyed into the existing completion assembly without re-completing the wellbore.

16. The method of claim 13, further comprising isolating first and second production zones of the hydrocarbon formation with a packer.

17. The method of claim 16, wherein the packer is disposed between the production tubular and the existing completion assembly.

18. The method of claim 16, wherein the first and second production zones have different permeabilities.

19. The method of claim 18, wherein the plurality of orifices are varied in density and size depending on the permeability of the first and second production zones.

20. The method of claim 13, wherein the tracing fluid comprises water, acid, gel, foam, or combinations thereof.

* * * * *